United States Patent [19]

Brentham

[11] 4,258,913

[45] Mar. 31, 1981

[54] FOREARM EXERCISER

[76] Inventor: Jerry D. Brentham, P.O. Box 599, Belton, Tex. 76513

[21] Appl. No.: 28,159

[22] Filed: Apr. 9, 1979

[51] Int. Cl.[3] ..... A63B 21/00

[52] U.S. Cl. ..... 272/67; 272/130; 272/143

[58] Field of Search ..... 272/67, 68, 130, 143

[56] References Cited

U.S. PATENT DOCUMENTS

| | | | |
|---|---|---|---|
| 2,819,081 | 1/1958 | Touraine | 272/67 |
| 3,400,793 | 9/1968 | Norris et al. | 272/67 X |
| 3,465,592 | 9/1969 | Perrine | 272/125 |
| 3,495,824 | 2/1970 | Cuinier | 272/130 |
| 3,702,188 | 11/1972 | Phillips et al. | 272/130 |

*Primary Examiner*—George J. Marlo

*Attorney, Agent, or Firm*—Gerald G. Crutsinger; John F. Booth; Harry C. Post, III

[57] ABSTRACT

A forearm exercising device having a support frame and a grip secured to one end of a shaft rotatably secured in said support frame and a crank arm secured on the opposite end of said shaft. A cylinder such as a shock absorber operably secured to the shaft controls the rate of movement of the shaft and the grip or crank arm to which the user applies his arm regardless of the force exerted thereon. An upper arm support and restraint member is adjustably secured to align the medial axis of the forearm with the axis of rotation of the shaft which the user is gripping such that movement is controlled as the user moves his hand through supination and pronation. A forearm support platform is secured such that the hand and wrist extend beyond the edge of the platform when gripping the crank arm to restrain forearm movement as the hand moves through palmarflexion and dorsiflexion in moving the crank arm at a controlled rate of speed.

11 Claims, 6 Drawing Figures

FIG. 2
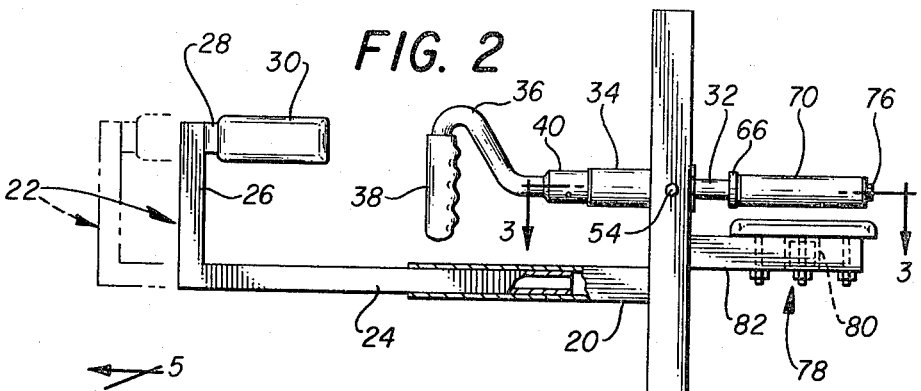
FIG. 1
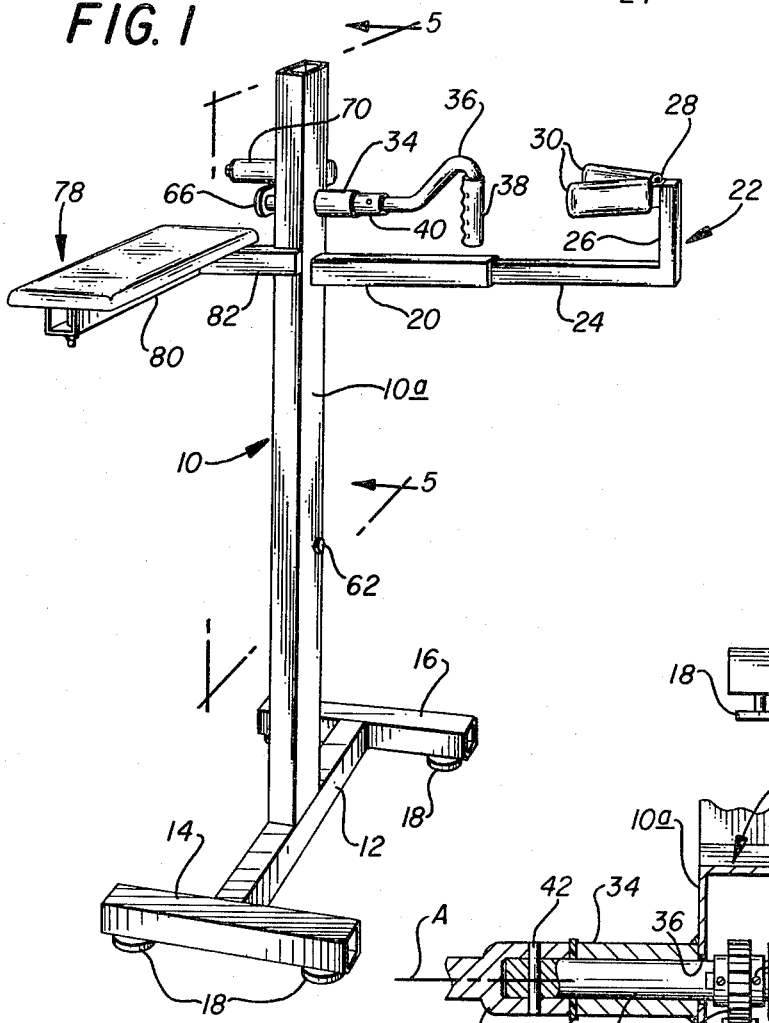
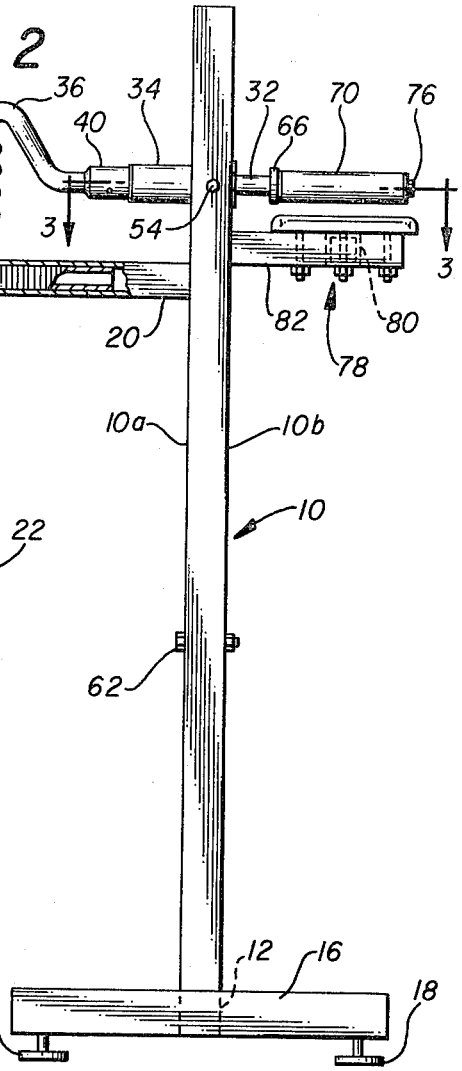
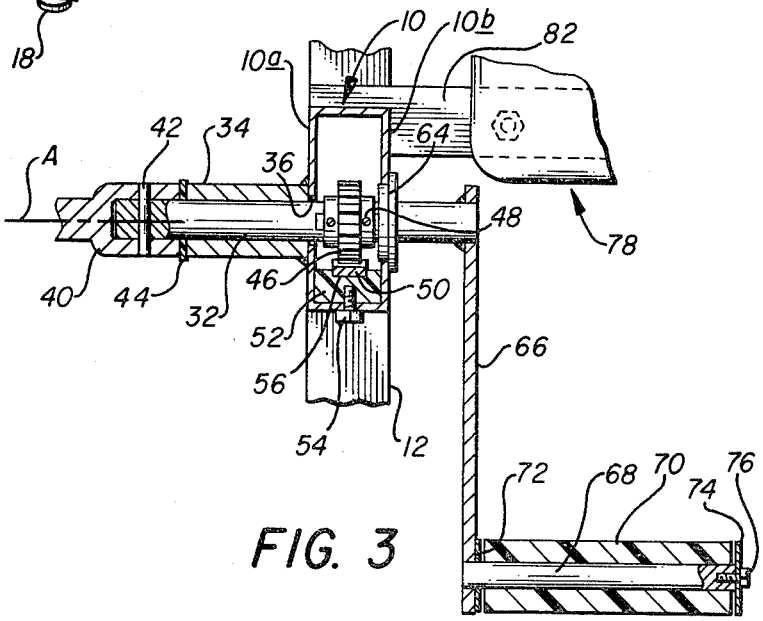
FIG. 3

FOREARM EXERCISER

BACKGROUND OF THE INVENTION

This invention relates to an exercising device particularly adapted to exercise the forearm and wrist muscles.

One of the most difficult injuries to prevent and rehabilitate is an injury to the forearm, particularly the wrist area. Many devices utilize the curl which exercises the upper arm; however, few devices have been devised which concentrate on the forward muscles of the arm and hand and limit motion of the rest of the body to isolate these muscles.

Further devices which have been devised for the arm usually utilize weights which means that the arm can be exercised in only a single direction when lifting the weight and no resistance occurs when moving the weight back to its lowermost position. It is particularly desirable to exercise the muscles in the arm equally in each direction to provide for proper muscle balance, thus minimizing the chance of injury.

SUMMARY

I have devised a forearm exercising device which utilizes a fluid flow resistance means adapted to resist movement equally in either direction. This device connects the fluid flow resistance means to a rack and pinion gear which is operably connected to a shaft extending out of the support housing. The shaft has a grip formed on one end thereof. An elbow support member is moved against the arm of the user such that the forearm is extending horizontally and the hand of the user grips the grip on the end of the shaft. The upper region of the arm is supported and restrained against movement by an upper arm support member. The axis of rotation on the shaft is generally aligned with the axis of rotation of the wrist and arm as they lie on a horizontal plane. The wrist is rotated to rotate the shaft which is resisted from moving by the fluid flow resistance means. Movement occurs and is resisted at a constant and equal rate throughout the range of movement.

The other end of the shaft has a link with a handle positioned over an arm support platform such that the wrist is exercised as the hand is moved up and down to pivot at the wrist.

A primary object of the invention is to strengthen the muscles of the forearm and wrist area to prevent injury from athletics and to lessen the possibility of injury due to tired muscles.

A further object of the invention is to provide a device which is capable of rehabilitating muscles which have been weakened due to injury.

A still further object of the invention is to provide a forearm exercising device which is capable of resisting movement at an equal rate throughout the range of movement to ensure that maximum effort is applied by the user equally throughout the range of movement.

BRIEF DESCRIPTION OF THE DRAWINGS

Drawings of a preferred embodiment of the invention have been annexed hereto so that the invention may be better and more fully understood, in which:

FIG. 1 is a perspective view of the forearm exercising device;

FIG. 2 is an elevational view thereof;

FIG. 3 is a cross-sectional view taken along line 3—3 of FIG. 2;

Numeral references are used to designate like parts throughout the various figures of the drawings.

BRIEF DESCRIPTION OF THE PREFERRED EMBODIMENT

Figure 5:
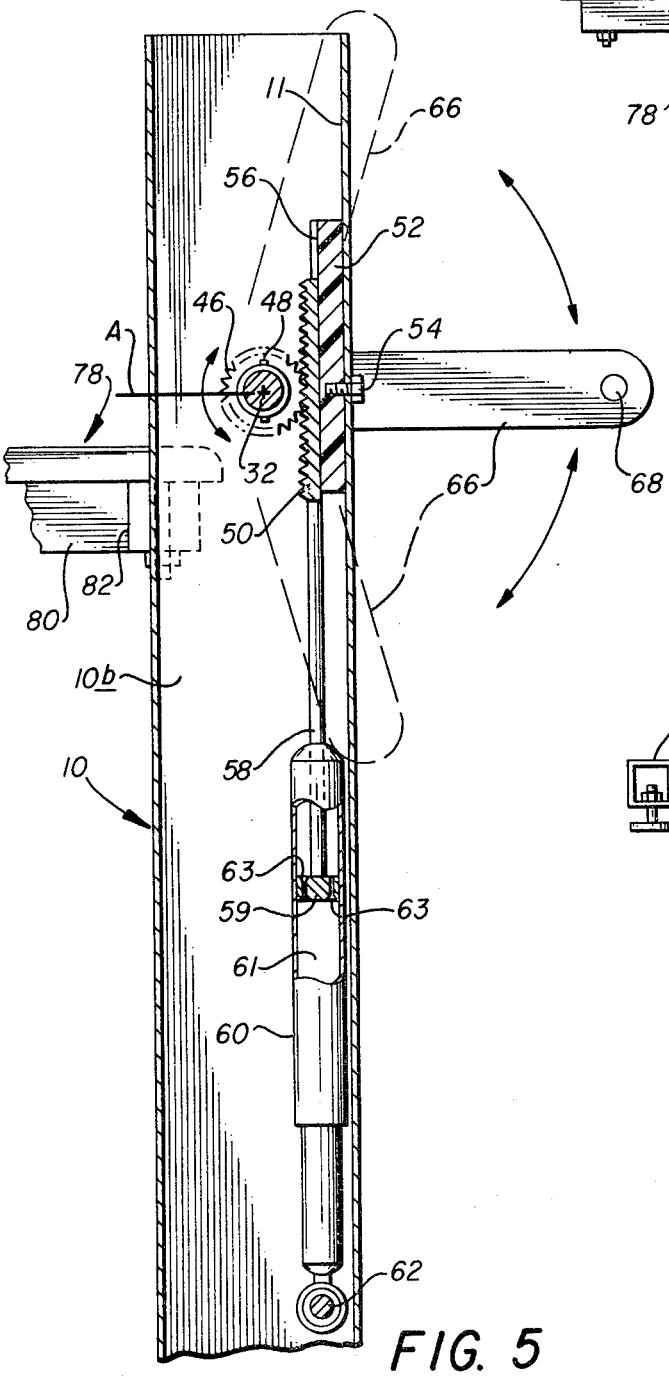
FIG. 5 is a cross-sectional view taken along line 5—5 of FIG. 1.
Figure 4:
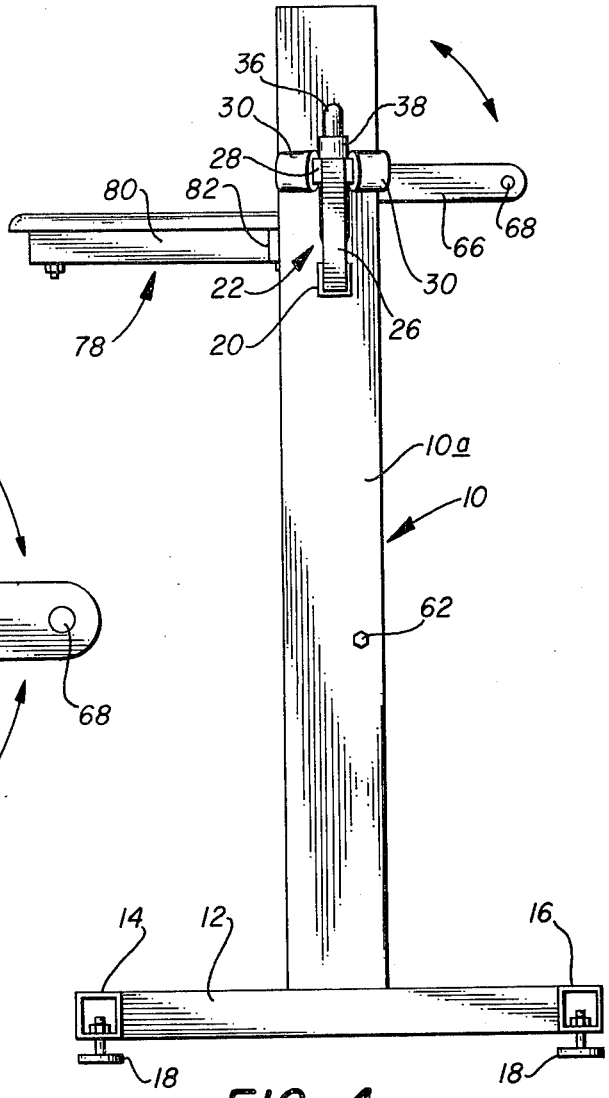
FIG. 4 is a side elevational view thereof.
Figure 6:
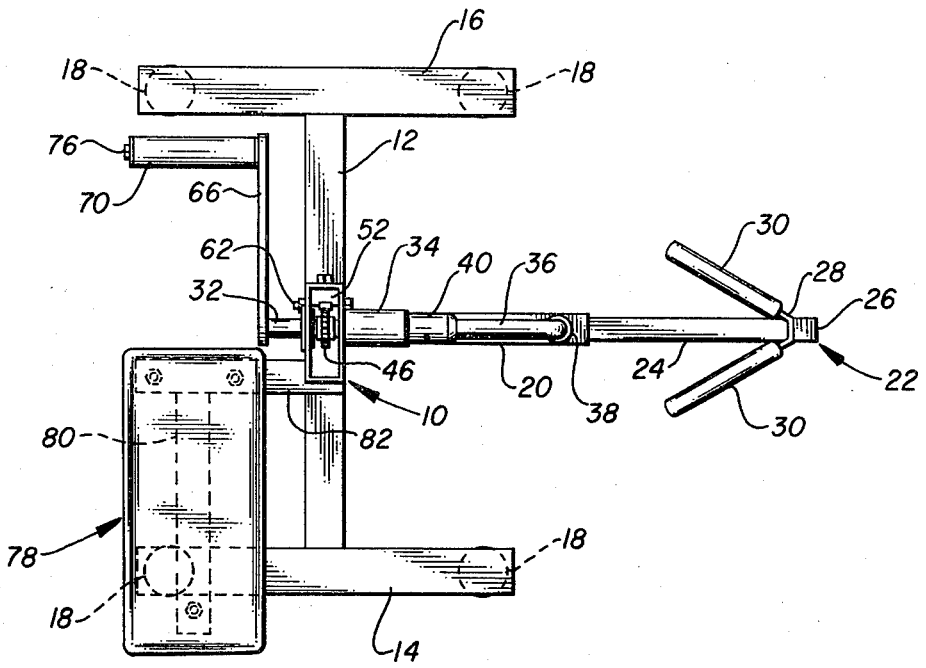
FIG. 6 is a plan view thereof.

Refering to FIG. 1 of the drawings, the device generally comprises a T-shaped frame having an upwardly extending center member 10 connected to a bottom member 12 which is secured to legs 14 and 16 having feet 18. An outwardly extending tubular hollow member 20 is secured to one side 10*a* of member 10.

Means to restrain movement of the upper arm generally comprises a J-shaped member 22 having the long leg 24 slidably disposed within the hollow tubular member 20. Transverse leg 26 is connected to a horizontally disposed short leg 28. A U-shaped member 30, having a covered padding secured thereto, is secured to short leg 28 and adapted to engage each side of the upper arm of the user to prevent movement of one's arm laterally of member 24.

A shaft 32 (FIGS. 2, 3 and 5) extends through member 10 and is rotatably supported by sleeve 34 welded or otherwise secured to aperture 36 formed in member 10. Gripping means such as an S-shaped handle 36 having a hand grip 38 is secured to a hollow end member 40 on shaft 32 by a pin 42 secured through aligned apertures in the end member 40 and shaft 32. A wear washer 44 is positioned between the end of sleeve 34 and end member 40. A gear 46 is secured to shaft 32 by set screws 48. Gear 46 engages rack 50 which is slidably disposed in guide track 52 secured to the inner bore 11 of member 10 by bolt 54. Guide track 52 has groove 56 formed therein to engage the smooth rear side of rack 50.

Rack 50 is secured to the upper end of actuated means such as a piston rod 58 slidably disposed in a cylinder 60 and is pivotally secured by a bolt 62 to the inner side of member 10. Cylinder 60 generally comprises a fluid flow resistance type cylinder wherein the rate of movement is controlled regardless of the force. The actuated means preferrably comprises a shock absorber which requires equal force to move the rod 58 in and out of the cylinder 60 throughout its range of movement. Rod 58 is secured to a piston 59 slidably disposed in chamber 61 of cylinder 60. Orifice 63 controls the rate of flow of fluid as the piston 59 moves in the chamber 61, thereby controlling the rate of movement.

As best illustrated in FIG. 3, the other end of shaft 32 is journaled through a bushing 64 and is rigidly secured to an arm 66. The outer end of arm 66 is rigidly secured to a shaft 68. A sleeve 70 is rotatably secured on shaft 68 between wear plates 72 and 74. Wear plate 74 is secured to the end of shaft 68 by bolt 76. A forearm support platform 78 is secured by bolts 79 to a longitudinal support member 80 which is secured to arm 82 welded or otherwise secured to member 10. Forearm support 78 is aligned approximately three-fourths ($\frac{3}{4}$) to one (1) inch down from the center of rotation A of shaft 32 and one (1) to one and one-half ($1\frac{1}{2}$) inches back from the axis of rotation A such that the center of rotation of the wrist is aligned with the center of rotation A of shaft 32. The length of arm 66 is substantially equal to the average length between the axis of rotation up and down of the wrist and the center of the palm of the hand which is approximately three (3) inches.

Operation of the hereinbefore described invention is as follows:

To utilize the device for exercising the rotation of the forearm, the upper portion of the arm is placed in a U-shaped padded portion 30 of the arm restraint member 22 and is adjusted such that the bottom portion of the U-shaped member 30 engages the rear portion of the arm as the hand is wrapped around grip 38. The exercising device is utilized by turning handle 30 clockwise for the full movement of the wrist and counterclockwise for the full movement of the wrist. This rotates shaft 32 which turns gear 48. Movement of gear 48 is resisted by rack 50 connected to cylinder 60. Cylinder 60 provides equal resistance to movement throughout the range of movement of the rotation of the forearm.

To exercise the muscles of the forearm for rotation of the wrist upwardly and downwardly relative to the forearm in a palm down position, the forearm is placed flat on the forearm support member 78 while the hand grips sleeve 70. With a firm grasp on the sleeve 70, one flexes his wrist downwardly and upwardly thus moving arm 66 downwardly and upwardly to rotate shaft 32. The rate of movement is held constant by the cylinder 60 such that after a predetermined magnitude of force is applied, a greater force will not move the shaft any faster. To perform an up palm flexure, the arm is turned over with the palm side up, the hand grips sleeve 70 and the wrist may be moved upwardly and downwardly. It should be noted that the axis of rotation A in performing the wrist flexures is aligned with the axis of rotation of the wrist. The edge of the forearm support 78 is positioned back from the axis of rotation to allow downward motion of the wrist when performing the flexures.

It should be readily apparent from the foregoing that the rate of motion is controlled when performing the act of pronation, turning the palm backward in medial rotation of the forearm and the reverse act of supination, turning the palm upward when turning grip 38. When laying the forearm flat on platform 78 in the palm down position and the hand of the user is gripping sleeve 70, the rate of motion of bending the hand backward in dorsiflexion and moving the palm downward in palmarflexion is controlled. Likewise, if the forearm is placed in a palm up position, the rate of motion of the wrist moving through dorsiflexion and palmarflexion is controlled also. Therefore, the rate of motion is controlled by the cylinder 60 in both medial rotation of the forearm and flexure of the wrist since both sets of muscles are stressed and strengthened.

Having described my invention, I claim:

1. A forearm exercising device comprising: a support frame; a shaft rotatably supported on said support frame; a grip secured to one end of said shaft; a crank arm secured to the opposite end of said shaft; actuated means operably secured to said shaft adapted to control the rate of movement of said grip and crank arm such that as a user grips the grip with a hand, the rate of movement of the hand is controlled as the user rotates the hand through supination and pronation and as a user grips the crank arm the rate of movement is controlled through palmarflexion and dorsiflexion.

2. The combination called for in claim 1 including: arm support means adapted to restrain an upper arm of a user and substantially align the medial axis of the forearm with the axis of rotation of said shaft; and forearm support means adapted to support the forearm of a user in a supine position such that the axis of rotation of the shaft is substantially aligned with the axis of pivotal movement of the wrist.

3. The combination called for in claim 2, wherein said arm support means comprises: a substantially U-shaped member adapted to restrain the upper arm; and a connector member adjustably secured to said support frame adapted to permit adjustment of the distance between the U-shaped member and said grip.

4. The combination called for in claim 1, wherein said actuated means comprises: a hollow chamber having fluid therein; a piston having an orifice formed therein; a piston rod secured to the piston and extending outwardly of the cylinder; means to secure said chamber to said support means; and means to moveably secure said piston rod to said shaft.

5. The combination called for in claim 4, wherein said means to moveably secure said piston rod comprises: a rack secured to said piston rod; guide means adapted to guide said rack; and a pinion gear on said shaft adapted to rotate with said shaft to move said rack and piston rod, said piston being moveable at a controlled rate controlled by the rate of movement of fluid through said piston.

6. The combination called for in claim 1 or 5, wherein the rate of movement in both directions is substantially equal.

7. The combination called for in claim 1, wherein said crank arm comprises: an arm secured to said shaft; a sleeve; and means rotatably securing said sleeve to an outer end of said shaft.

8. The combination called for in claim 1, wherein said support frame comprises: a hollow member; and legs to support said hollow member in an upright position.

9. A forearm exercising device comprising: a support frame; actuating means; means rotatably supporting said actuating means on said support frame; arm support means on said support frame to support the arm of a user such that the axis of rotation of the actuating means is aligned with the axis of rotation of a wrist; grip means on said actuating means adapted to allow the hand of the user to grip and rotate said actuating means; a cylinder body having a chamber formed therein; fluid in said chamber; a piston slideably disposed in said chamber; a piston rod secured to said piston and extending outwardly of said cylinder body, said piston having an orifice formed therein to control flow of fluid through the piston to a portion of the chamber on the opposite side of the piston to resist movement of said piston rod; means securing said actuating means to said piston rod; and means securing said cylinder body to said support frame.

10. A forearm exercising device comprising: a support frame; actuating means; means rotatably supporting said actuating means on said support frame; actuated means operably secured to the actuating means adapted to control the rate of movement of the actuating means equally in each direction; a U-shaped bracket adapted to engage the rear portion of the upper arm above the elbow; means to adjustably secure said U-shaped bracket to said support frame to allow adjustment of the position of the U-shaped bracket outwardly from the support frame and positioning said support bracket such that longitudinal axis of the forearm is substantially aligned with the axis of rotation of the actuating means.

11. The combination called for in claim 10, including: a platform; means to secure said platform to said support frame such that the transverse axis of rotation of the wrist will be substantially aligned with the axis of rotation of the actuating means to allow upwardly and downwardly movement of the wrist relative to the forearm; and means secured to said actuating means adjacent said platform to rotate said actuating means to exercise a wrist.

* * * * *